US006144827A

United States Patent [19]

Iikura

[11] Patent Number: 6,144,827

[45] Date of Patent: Nov. 7, 2000

[54] LIQUID IMAGE FORMING APPARATUS, SQUEEZE ROLLER, AND PROCESS FOR RENEWING SURFACE OF SQUEEZE ROLLER

[75] Inventor: Kazuaki Iikura, Kashiwazaki, Japan

[73] Assignee: NEC Corporation, Tokyo, Japan

[21] Appl. No.: 09/399,289

[22] Filed: Sep. 17, 1999

[30] Foreign Application Priority Data

Sep. 22, 1998 [JP] Japan ..... 10-284740

[51] Int. Cl.[7] ..... G03G 15/10

[52] U.S. Cl. ..... 399/249; 399/274; 399/284

[58] Field of Search ..... 118/661; 399/237, 399/249; 430/117, 118, 119

[56] References Cited

U.S. PATENT DOCUMENTS

| | | | |
|---|---|---|---|
| 3,807,853 | 4/1974 | Hudson | 399/249 |
| 4,286,039 | 8/1981 | Landa et al. | 399/249 |
| 5,571,463 | 11/1996 | Sypula et al. | 399/249 |

FOREIGN PATENT DOCUMENTS

| | | |
|---|---|---|
| 4-30190 | 2/1992 | Japan . |
| 7-175331 | 7/1995 | Japan . |
| 7-225516 | 8/1995 | Japan . |
| 7-271177 | 10/1995 | Japan . |
| 9-218587 | 8/1997 | Japan . |

*Primary Examiner*—Arthur T. Grimley
*Assistant Examiner*—Hoang Ngo
*Attorney, Agent, or Firm*—Ostrolenk, Faber, Gerb & Soffen, LLP

[57] ABSTRACT

The objects of the invention are to provide a liquid image forming apparatus in which the roughness of the surface of a squeeze roller to remove the carrier in the liquid developer or the excess developing material from the photosensitive member is kept as constant as possible and to provide a squeeze roller and a process for renewing the surface of a squeeze roller. In a liquid image forming apparatus having a squeeze roller 15 in pressure contact with a photosensitive member 1 for wiping off excess liquid developer 6 and a blade 11 for removing the liquid developer 6 adhering to the squeeze roller 15, the squeeze roller comprises a minutely foamed rubber.

9 Claims, 1 Drawing Sheet

LIQUID IMAGE FORMING APPARATUS, SQUEEZE ROLLER, AND PROCESS FOR RENEWING SURFACE OF SQUEEZE ROLLER

BACKGROUND OF THE INVENTION

1. Field of the Invention

The present invention relates to a liquid image forming apparatus. In particular, the present invention relates to a liquid image forming apparatus having a squeeze roller which is squeezed against a photosensitive member to wipe off excess liquid developer, which is applied to the photosensitive member, or a carrier in the liquid developer, to the squeeze roller, and to a liquid process for renewing the surface of the squeeze roller.

This application is based on Japanese Patent Application No. Hei 10-284740, the content of which is incorporated herein by reference.

2. Description of Related Art Including Information Disclosed Under 37 CFR 1.97 and 37 CFR 1.98

In a conventional liquid image forming apparatus as indicated by reference numeral 12 in FIG. 2, an electrifier 2 charges the recording surface of a photosensitive member 1 which is moved in a single direction upon starting the apparatus, thereafter a latent image is formed by exposing the recording surface to a light 4 which is emitted from an exposure device 3, then development is carried out by applying liquid developer 6, which comprises a developing material 7 and a carrier 8 and is supplied by a liquid developer supplier 5, to the recording surface of the photosensitive member 1 using a developing roller 9, then a squeeze roller 10 is squeezed against a photosensitive member to wipe off the carrier 8 contained in the liquid developer 6 or excess developing material 7, and then the surface of the squeeze roller 10 is cleaned by removing the carrier 8 or the excess developing material 7 adhering to the squeeze roller 10 using a blade 11.

The surface of the squeeze roller 10 in the liquid forming apparatus is roughened to a certain degree by a surface roughening process in order to wipe off the excess developing material 7 or the carrier 8 by squeezing. However, there is a problem in that when the carrier 8 or the excess developing material 7 is removed from the surface of the squeeze roller 10 by the blade 11, the surface of the squeeze roller is abraded and smoothed, which degrades the ability to remove the carrier 8 or the excess developing material 7.

The prior art relating to liquid image forming apparatuses are disclosed in Japanese Unexamined Patent Applications, First Publications (Kokai), Nos. 4-30190 (published on Feb. 3, 1992), 7-175331 (published on Jul. 14, 1995), 7-225516 (published on Aug. 22, 1995), 7-271177 (published on Oct. 20, 1995) and 9-218587 (published on Aug. 19, 1997).

BRIEF SUMMARY OF THE INVENTION

The present invention was achieved in view of the problem in the conventional art. An object of the present invention is to provide a liquid image forming apparatus in which the roughness of the surface of the squeeze roller to remove the carrier in the liquid developer or the excess developing material from the photosensitive member is kept as constant as possible. Another object of the present invention is to provide a squeeze roller and a process for renewing the surface of a squeeze roller.

In order to accomplish the above objects, in a liquid image forming apparatus according to the present invention having an exposure device for forming a latent image on a photosensitive member, a developing roller for developing the photosensitive member by applying liquid developer containing a carrier to the photosensitive member, a squeeze roller in pressure contact with the photosensitive member for wiping off excess liquid developer, and a blade for removing the liquid developer adhering to the squeeze roller, the squeeze roller is characterized by comprising a foamed rubber.

The foamed rubber may be made from a rubber selected from the group consisting of natural rubbers and synthetic rubbers.

In addition, a process for renewing the surface of a squeeze roller according to the present invention is a process for renewing the surface of a squeeze roller in a liquid image forming apparatus having an exposure device for forming a latent image on a photosensitive member, a developing roller for developing the photosensitive member by applying liquid developer containing a carrier to the photosensitive member, a squeeze roller in pressure contact with the photosensitive member for wiping off excess liquid developer, and a blade for removing the liquid developer adhering to the squeeze roller, wherein the squeeze roller comprises a foamed rubber, and the process for renewing the surface of the squeeze roller is characterized by comprising the step of shaving the surface of the squeeze roller as the squeeze roller rotates so as to remove its surface of the squeeze roller which has been worn smooth and constantly maintain a predetermined surface roughness.

Since a squeeze roller having a uniform internal structure having a proper void distribution is obtained by making the squeeze roller from a foamed rubber, the liquid image forming apparatus and the process for renewing the surface of the squeeze roller according to the present invention allow the squeeze roller to keep having regular roughness of a fresh surface which is obtained by shaving the surface of the squeeze roller with the blade.

Accordingly, degradation in the function of the squeeze roller for removing excess liquid developer can be avoided, and the quality of the images formed by the liquid image forming apparatus can be maintained over a long period.

DETAILED DESCRIPTION OF THE INVENTION

The foamed rubber used in the present invention is preferably a minutely foamed rubber, which has voids having an average size equal to or less than 100 $\mu$m.

In the liquid image forming apparatus according to the present invention, the foamed rubber may be made from an organic halogen-containing elastomer.

By making the formed rubber from an organic halogen-containing elastomer, its high intermolecular bond energy and excellent solvent resistance property enable production of a suitable squeeze roller.

The liquid image forming apparatus according to the present invention may be provided with an auxiliary blade in pressure contact with the squeeze roller for shaving the surface of the squeeze roller.

In this case, it is preferable that the auxiliary blade be disposed behind the blade with respect to the direction of rotation of the squeeze roller and in the vicinity of the blade.

With the provision of the auxiliary blade, since the surface of the squeeze roller is actively shaved by the auxiliary blade, even if irregularities on the surface of the squeeze roller are filled with the liquid developer adhering to the squeeze roller, the liquid developer can be completely removed, and a proper surface roughness can be maintained.

The auxiliary blade may be made of a metal sheet.

Alternatively, the auxiliary blade may be made of a resin sheet.

By making the auxiliary blade of a metal sheet or a resin sheet, deformation, such as warp, of the auxiliary blade can be prevented, and the shaving of the surface of the squeeze roller can be surely performed.

Next, an embodiment according to the present invention will be described, reference being made to FIG. 1.

Figure 2:
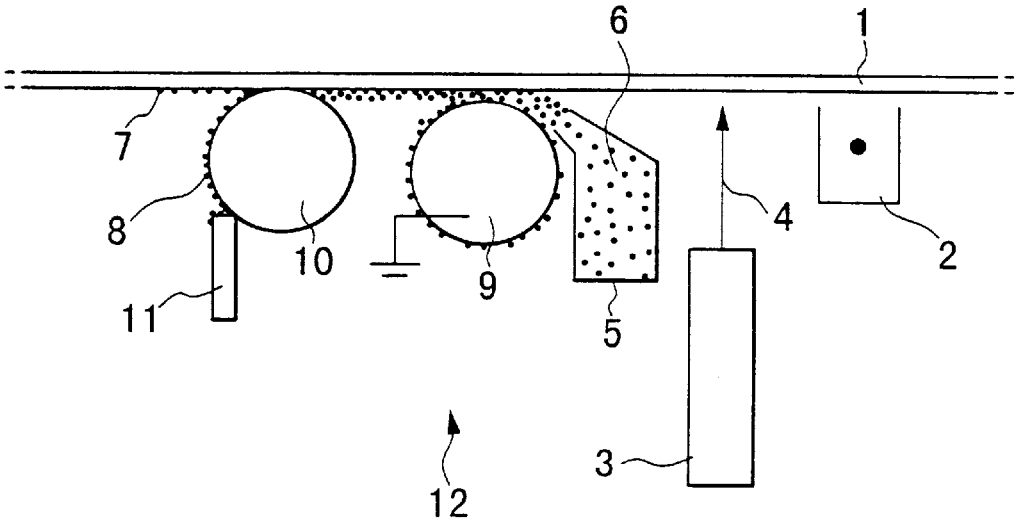
FIG. 2 (PRIOR ART)
FIG. 2 is a schematic view showing a main portion of an example of a conventional structure.

In the following description, components which are common with those in FIG. 2 are described with the same reference numerals assigned to them.

Figure 1:
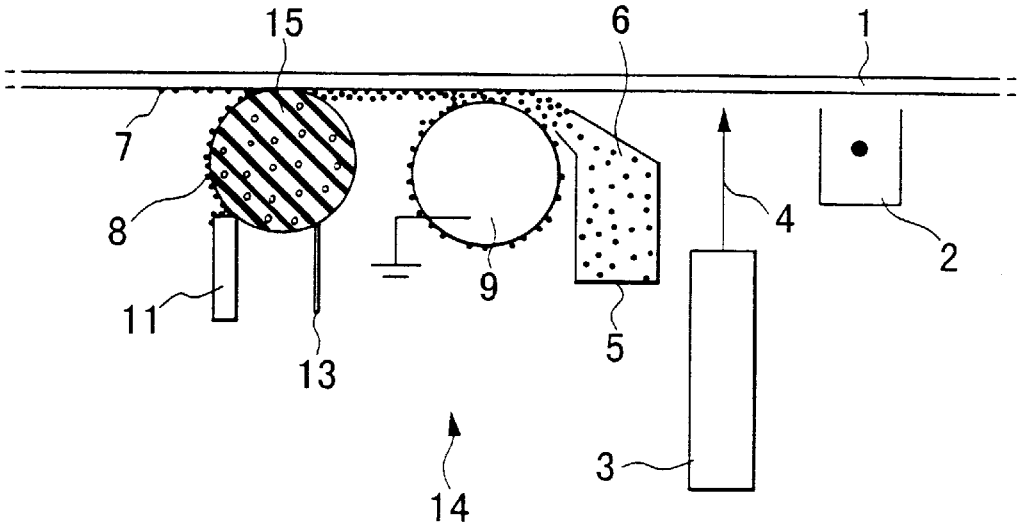
FIG. 1 is a schematic view showing a main portion of an embodiment of the present invention.

The basic structure of the liquid image forming apparatus of this embodiment, which is indicated by reference numeral 14 in FIG. 1, comprises an electrifier 2 for charging the recording surface of a photosensitive member 1, an exposure device for forming a latent image by irradiating the recording surface of the photosensitive member with a light 4, a developing roller 9 for applying liquid developer 6, which is supplied by a liquid developer supplier 5, to the recording surface of the photosensitive member 1, a squeeze roller 15 which is in contact with the recording surface of the photosensitive member 1 and wipes off an excess of the liquid developer 6 which has been developed on the recording surface or a carrier 8 contained in the liquid developer 6, a blade 11 which is put to the squeeze roller 15 for scraping off the liquid developer 6 or the carrier 8 adhering to the squeeze roller 15, and an auxiliary blade 13 which is disposed in the vicinity of the blade 11 for shaving the surface of the squeeze roller 15 by a minute amount.

An electric potential is applied to the developing roller 9 so that an electrical field is created between the developing roller 9 and the photosensitive member 1.

The squeeze roller 15 is composed of a minutely foamed rubber and has a uniform void distribution from the surface to the central portion. The material for the minutely foamed rubber is selected from natural rubbers and synthetic rubbers. A specific example of a preferable material is an organic halogen-containing elastomer. This is because the organic halogen-containing elastomer is durable due to its high intermolecular bond energy, and is excellent in solvent resistance.

The auxiliary blade 13 is made of a metal sheet or a resin sheet. The auxiliary blade 13 is disposed behind the blade 11 with respect to the direction of rotation of the squeeze roller 15 and in the vicinity of the blade 11, where the distal edge of the auxiliary blade 13 is in pressure contact with the surface of the squeeze roller 15 so as to shave the surface of the squeeze roller 15 by a minute amount as the squeeze roller 15 rotates.

Next, the action of the liquid image forming apparatus 14 according to the embodiment having the above structure will be explained.

First, upon starting the apparatus and inputting image data, the photosensitive member 1 is moved at a constant speed. After the recording surface of the photosensitive member 1 is charged by the electrifier 2, a latent image is formed on the recording surface of the photosensitive member 1 by the exposure device 3 based on the image data.

Then, the liquid developer supplier 5 supplies the liquid developer 6 to the surface of the developing roller 9, and the latent image formed on the photosensitive member 1 is developed utilizing a difference in electric potential between the developing roller 9 and the latent image. Subsequently, the carrier 8 contained in the liquid developer 6 on the recording surface of the photosensitive material 1 or the developing material 7 in excess liquid developer 6 is wiped off by the squeeze roller 15.

Furthermore, the liquid developer 6 or the carrier 8 which is wiped off by the squeeze roller 15 is carried toward the blade 11 as the squeeze roller 15 rotates, and reaches the blade 11 to be scraped off from the squeeze roller 15 by the blade 11.

At this time, as a result of the action of the blade 11 scraping off the liquid developer 6, a minute amount of the surface of the squeeze roller 15 is shaved off by the blade 11 to reveal a fresh surface. Since the squeeze roller 15 is made of a minutely foamed rubber and has an internal structure having a uniform void distribution, a constant roughness of the fresh surface, which is formed by the above-described shaving, can be maintained.

Accordingly, the surface of the squeeze roller 15 having regular roughness is constantly in contact with the photosensitive member 1, and the liquid developer 6 or the carrier 8 can be surely and steadily wiped off from the photosensitive member 1.

In this embodiment, since auxiliary blade 13 is provided behind the blade 11, the surface of the squeeze roller 15 is further shaved, the surface of the squeeze roller 15 is furthermore surely cleaned so that filled-up irregularities can be removed, and uniform roughness can be obtained.

When the blade 11, which is disposed in front, shaves the surface of the squeeze roller 15, there remains the possibility that the liquid developer 6 or the carrier 8 remains to fill up the irregularity of the surface since the efficiency of shaving is low due to the liquid developer 6 or the carrier 8 intervening between the blade 11 and the squeeze roller 15. However, the provision of the auxiliary blade 13 as in this embodiment avoids such an inconvenience.

Accordingly, this embodiment allows stable removal of the excess liquid developer 6 or the carrier 8 from the photosensitive member 1 by constantly maintaining regular roughness of the surface of the squeeze roller 15 and long term maintenance of quality of images which are formed by the liquid image forming apparatus 14.

It is noted that shapes, sizes, and the like, of the components described for this embodiments are examples, and they are modifiable in various ways according to requirements in designing or the like.

What is claimed is:

1. A liquid image forming apparatus having an exposure device for forming a latent image on a photosensitive member, a developing roller for developing the photosensitive member by applying liquid developer containing a carrier to the photosensitive member, a squeeze roller in pressure contact with the photosensitive member for wiping off excess liquid developer, and a blade for removing the liquid developer adhering to the squeeze roller, wherein the squeeze roller comprises a foamed rubber, and an auxiliary blade in pressure contact with the squeeze roller for shaving the surface of the squeeze roller.

2. A liquid image forming apparatus according to claim 1, wherein the foamed rubber has voids having an average size equal to or less than 100 $\mu$m.

3. A liquid image forming apparatus according to claim 1, wherein the foamed rubber is made from a rubber selected from the group consisting of natural rubbers and synthetic rubbers.

4. A liquid image forming apparatus according to claim 1, wherein the foamed rubber is made from an organic halogen-containing elastomer.

5. A liquid image forming apparatus according to claim 1, wherein the auxiliary blade is disposed behind the blade with respect to the direction of rotation of the squeeze roller and in the vicinity of the blade.

6. A liquid image forming apparatus according to claim 1, wherein the auxiliary blade is made of a metal sheet.

7. A liquid image forming apparatus according to claim 1, wherein the auxiliary blade is made of a resin sheet.

8. A process for renewing the surface of a squeeze roller in a liquid image forming apparatus having an exposure device for forming a latent image on a photosensitive member, a developing roller for developing the photosensitive member by applying liquid developer containing a carrier to the photosensitive member, a squeeze roller in pressure contact with the photosensitive member for wiping off excess liquid developer, and a blade for removing the liquid developer adhering to the squeeze roller, wherein the squeeze roller comprises a foamed rubber, and the process for renewing the surface of the squeeze roller comprises the step of shaving the surface of the squeeze roller as the squeeze roller rotates so as to remove the surface of the squeeze roller which has been worn smooth and constantly maintain a predetermined surface roughness.

9. A process for renewing the surface of a squeeze roller according to claim 8, wherein the foamed rubber has voids having an average size equal to or less than 100 $\mu$m.

* * * * *